350-331 SR
XR 4,027,305
1A 310B

United State
Kishimoto

1] 4,027,305
5] May 31, 1977

[54] SYSTEM FOR DRIVING LIQUID CRYSTAL DISPLAY DEVICE

[75] Inventor: Juji Kishimoto, Tokyo, Japan

[73] Assignee: Canon Kabushiki Kaisha, Tokyo, Japan

[22] Filed: Apr. 8, 1975

[21] Appl. No.: 566,064

Related U.S. Application Data

[63] Continuation of Ser. No. 422,166, Dec. 6, 1973.

[30] Foreign Application Priority Data

Aug. 9, 1973 Japan ..... 48-89488

[52] U.S. Cl. ..... 340/336; 350/160 LC
[51] Int. Cl.[2] ..... G08B 5/36; G02F 1/13
[58] Field of Search ..... 340/324 R, 336; 350/160 LC

[56] References Cited

UNITED STATES PATENTS

| | | | |
|---|---|---|---|
| 3,701,249 | 10/1972 | Bergey et al. | 350/160 LC |
| 3,740,717 | 6/1973 | Huener et al. | 340/336 |
| 3,744,049 | 7/1973 | Luce | 340/336 |
| 3,750,139 | 7/1973 | Blishak | 340/336 |
| 3,760,406 | 9/1973 | Walton | 340/336 |
| 3,845,615 | 11/1974 | Cake | 340/336 |
| 3,863,247 | 1/1975 | Hosokawa | 340/336 |
| 3,868,674 | 2/1975 | Lorteije | 340/324 M |

*Primary Examiner*—David L. Trafton

[57] ABSTRACT

A liquid crystal display device is driven by alternating current applied thereto by a switching circuit comprising a group of MOS transistors. The transistors are switched in response to display signals applied to the respective gate electrodes by a control circuit such as the output circuitry of a computer.

10 Claims, 28 Drawing Figures

T
t1
t2
t3

BCD CODE TO 7 SEGMENT CONVERTER
INDICATING REGISTER
TIMING ENABLE SIGNAL GENERATOR
Vss
nth DIGIT
(n-1)th DIGIT
FIRST DIGIT
Tn
Tn-1
T1
LC
p
h
g
a
9
11
13
14
15
16
17
18
19
20
21
22

FIG. 22
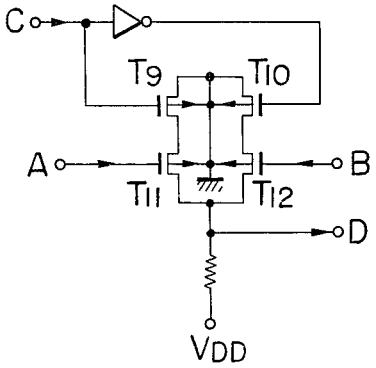
FIG. 25
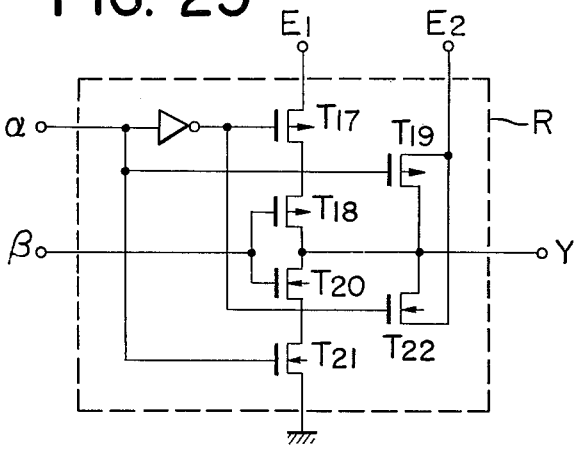
FIG. 23
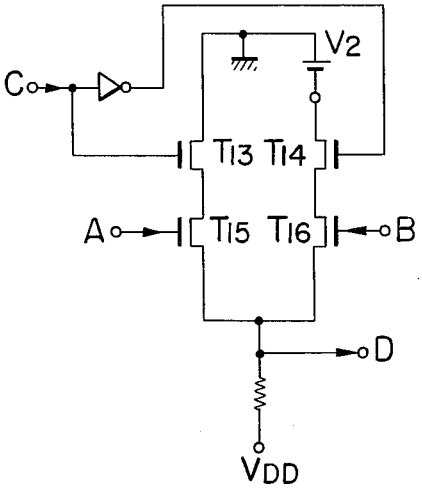
FIG. 26
| LOGIC LEVEL | | OUTPUT VOLTAGE |
|---|---|---|
| α | β | Y |
| 0 | 1 | V2 |
| 0 | 0 | V2 |
| 1 | 1 | 0 |
| 1 | 0 | V1 |
FIG. 28
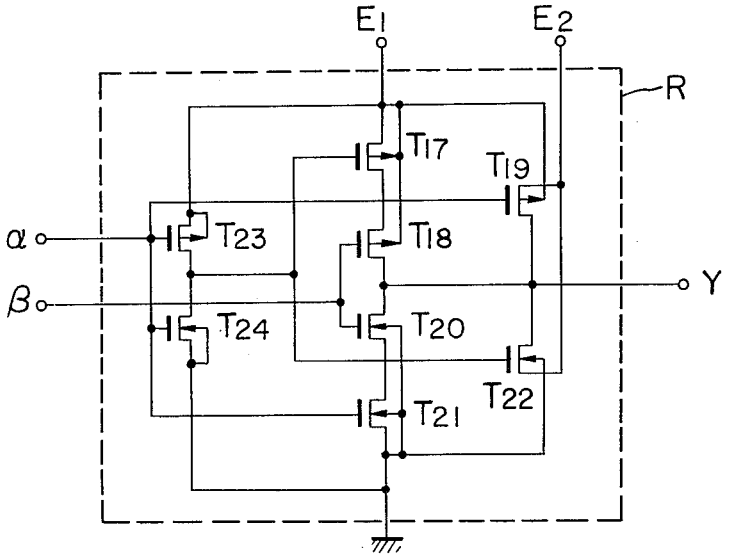

SYSTEM FOR DRIVING LIQUID CRYSTAL DISPLAY DEVICE

This is a continuation, of application Ser. No. 422,166, filed Dec. 6, 1973.

BACKGROUND OF THE INVENTION

1. Field of the Invention

The present invention relates to a system for driving a display device utilizing liquid crystals, and, more particularly, a system capable of increasing remarkably the service life of the crystal liquid used in the display device. The system for driving a liquid crystal display device in accordance with the present invention is especially effective for application to large scale integrated circuit devices.

2. Description of the Prior Art

In the past, DC or pulse driving systems have been used for driving liquid crystal display devices. The service life of the liquid crystal used in the display devices is greatly dependent on voltage and current applied thereto. Even when a driving voltage is used which is less than a breakdown voltage of the liquid crystal, to drive the display device without changing the polarity, the composition of the liquid crystal is changed when such voltage is applied for a long time so that it gradually degenerates in function. For example, in a liquid crystal display device utilizing the para-amino-phenyl-acetate (APAPA), in which the total thickness of the liquid crystal is of the order of 25 microns, the contrast ration, that is the difference in light transmission bwtween a portion to which the voltage is applied and a portion to which no voltage is applied, is increased as the applied DC current is increased. For example, the reflection contrast is saturated at 40 – 50 volts. Therefore, a high voltage cannot be applied in the case of a dynamic display. Furthermore when the DC voltage is applied, the service life of the crystal becomes very short, and craters and blurs are produced in hundreds of hours.

One of the objects of the present invention is therefore to provide an improved system for driving a liquid crystal display device.

Another object of the present invention is to provide a system for driving a liquid crystal display device in which the liquid crystal is driven not by direct current, but by alternating current, thereby increasing the service life of the liquid crystal.

Another object of the present invention is to provide a system for driving a liquid crystal display device which is simple in construction and capable of utilizing as a power source a residential electric distribution line source.

Another object of the present invention is to provide a system for driving a liquid crystal display device which is adapted for dynamic display.

Another object of the present invention is to provide a system for driving a liquid crystal display device especially adapted for use with large scale integrated circuit devices whose elements are MOS-FET or metal oxide semiconductor field-effect transitors.

The above and other objects, features and advantages of the present invention will become more apparent from the following description of the preferred embodiments thereof taken in conjunction with the accompanying drawings in which:

FIGS. 22 and 23 show circuit diagrams of other variations of the circuit shown in FIG. 18;

FIG. 25 shows a circuit diagram of an example of a driving circuit R used in the embodiment shown in FIG. 24;

FIG. 26 shows a truth table for explanation of the operation of the circuit shown in FIG. 25;

FIG. 28 shows a circuit diagram of a variation of the circuit shown in FIG. 25, in which the inventor also is constructed with MOS transistors.

DESCRIPTION OF THE PREFERRED EMBODIMENTS

Figure 1:
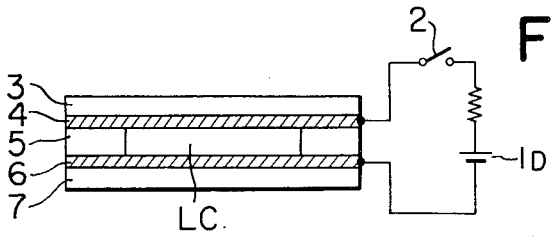
FIG. 1 is a diagrammatic view of a prior art system for driving a liquid crystal display with a DC power source.

The prior art liquid crystal display device illustrated diagrammatically in FIG. 1 is driven by a system in which a voltage applied from a DC power source $1_D$ is switched by a switch 2 so that the service life of the display device is too short for practical applications. The liquid crystal display device comprises in general a pair of outer transparent glass plates 3 and 7, a transparent electrode 4 such as the elctrode commercially available under the trademark of NESA electrode, a pair of spacers 5 made of an insulating material such as "Mylar" (trademark, supplied by Dupont), a thin film 6 deposited by the vacuum evaporation of $N_i$ and Al, and a liquid crystal LC.

Figure 2:
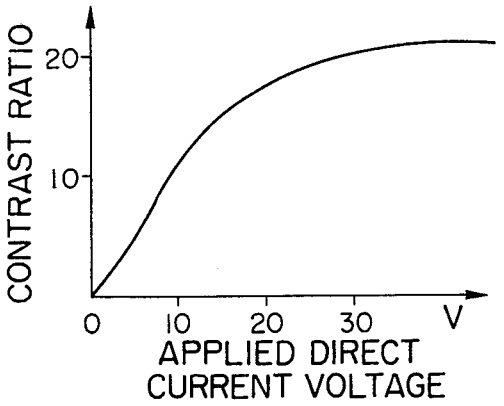
FIG. 2 is a graph illustrating the relationship between the DC voltage applied and the contrast ratio.

FIG 2 depicts an applied direct current-contrast ratio curve of the display device shown in FIG. 1. When the liquid crystal display device is driven by direct current, it is saturated with applied voltage over about 35 voltage.

Figure 3:
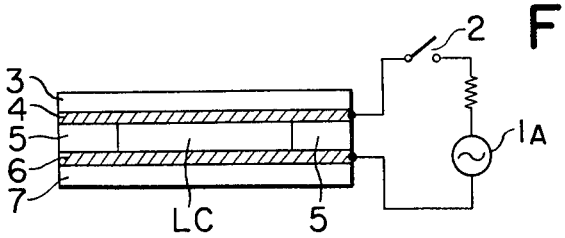
FIG. 3 is a diagrammatic view illustrating a principle of the present invention.

According to the present invention the liquid crystal display device of the type described is driven by an AC power source $1_A$ shown in FIG. 3. The elements corresponding to those of FIG. 1 are assigned the same reference designations. The voltage applied across the liquid crystal display device is controlled by the switch 2 so that the polarity applied to the opposing electrodes 4 and 6 is reversed at each cycle, and it has been confirmed that the service life of the display device driven as in FIG. 3 may be increased over ten times that of the prior art display device.

Figure 4:
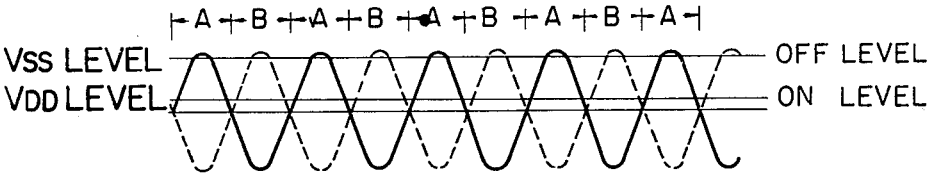
FIG. 4 is a graph illustrating the voltage waveform of the power source used in the present invention.
Figure 7:
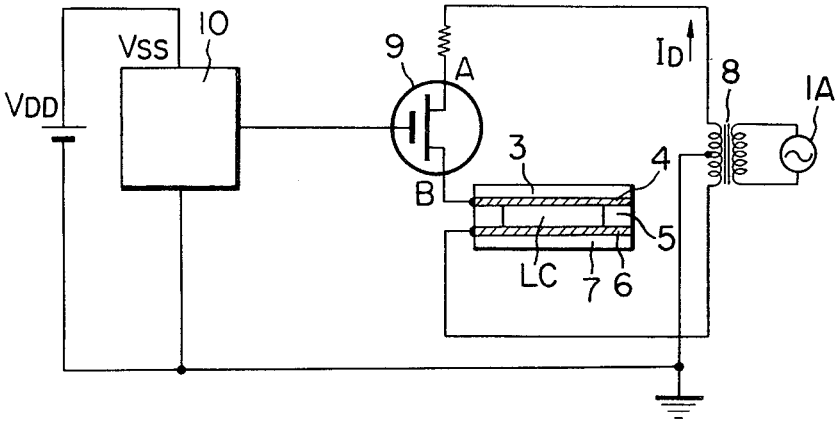
FIG. 7 is a circuit diagram of a first embodiment of a system for driving a liquid crystal display device constructed in accordance with the present invention.

Furthermore, the inventor has succeeded in providing drive circuits utilizing MOS transistors which are very advantageous in the manufacture of large scale integrated circuits as will be described in more detail hereinafter. According to the present invention, the AC power source $1_A$ is used as shown in FIG. 7, with the AC power source being for example a commercial electric distribution line to a residence. Referring to FIG. 7 showing one embodiment of the invention, the source or drain of a MOS field-effect transistor or MOS-FET is connected to the electrode 4 of the liquid crystal display device, and one terminal of the secondary of a transformer 8 is connected to the electrode 6 while the center-tap of the secondary of the transformer 8 is connected to ground. The gate of the MOS-FET is connected to a control circuit 10. In general, a MOS-FET is bipolar so that its drain may be used as a source while the source may be used as the drain depending upon the polarity of the voltage applied. That is, as shown in FIG. 4, the two principal conducting electrodes A and B of the MOS-FET function alternately as the source and drain at each half cycle. More specifically, in the first half cycle the electrode A functions as the source and in the second half cycle it functions as the drain. To the gate of the MOS-FET is normally applied a voltage Vss of off-signal level from the control circuit.

The control circuit 10, which is for example an output circuit for an electronic computer comprises MOS integrated circuits, and since the bias voltage source $V_{DD}$ the MOS-FET is connected to the midpoint of the secondary of the transformer 8, the AC voltage is applied to the electrodes A and B of the MOS-FET, and thus to the electrodes 4 and 6 of the liquid crystal display device, with the voltage $V_{DD}$ as a reference voltage. The difference of the reference voltage $V_{DD}$ and the voltage Vss of off-signal level is 15 volts. When a display signal is appled from the control circuit 10 to the MOS-FET 9 to turn it into the conduction stage, the voltage of the AC power source 1 is applied across the electrodes 4 and 6 of the liquid crystal display device to display a numeral or the like. The level of the display signal is such that the potential at the gate of the MOS-FET is more negatively driven than the threshold voltage relative to the potential at the source of the M0S-FET.

Figure 5:
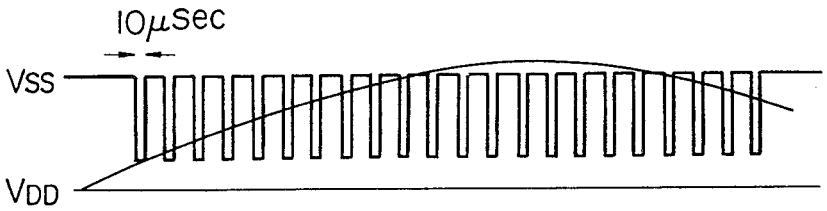
FIG. 5 is a view similar to FIG. 4 illustrating the voltage waveform on enlarged time scale when the display signal is being applied.
Figure 6:
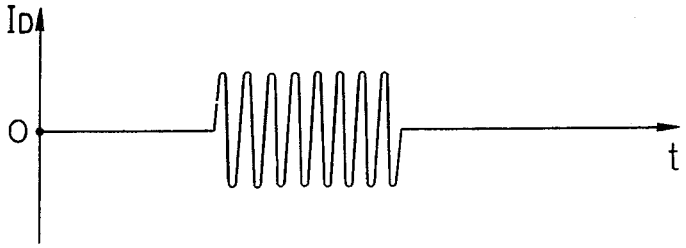
FIG. 6 is a graph illustrating the waveform of the driving current applied to the liquid crystal.

Thus, when the display signal is applied, the driving current as shown in FIG. 6 flows. Since the liquid crystal display device has a high internal resistance, the voltage applied across the electrodes 4 and 6 varies depending upon the frequency of the AC power source 1 (50 or 60 Hz) without being influenced by the pulse width even though the display device is driven with pulses having widths of for example 10 micro-seconds. Therefore, even when the control circuit is actuated at a very high frequency of for example 100 KHz, the function of the display device is not influenced. This is shown in FIG. 5.

Figure 8:
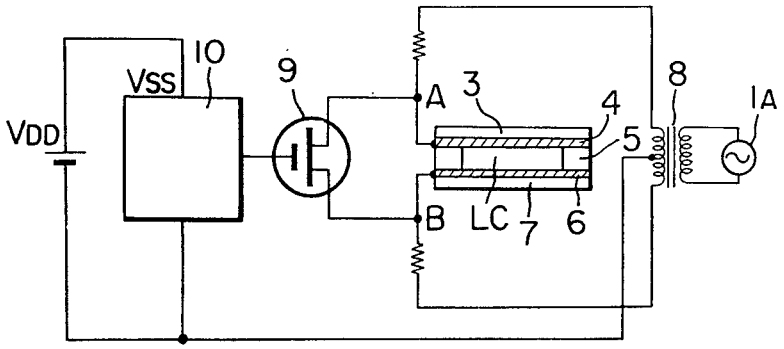
FIG. 8 is a circuit diagram of a second embodiment of the present invention.

In the second embodiment as illustrated in FIG. 8 the voltage is applied to the gate of the MOS-FET to cause it to conduct at the instant when the power source is connected, so that no voltage is applied across the electrodes 4 and 6 of the liquid crystal display device. Therefore, the display device remains blank. When the off-level display signal is applied from the control circuit 10 to the gate of the MOS-FET 9 to cut it off, the voltage from the power source 11 is applied across the electrodes 4 and 6 of the display device to display a numeral or the like.

As described above, according to the present invention, the liquid crystal display device is driven with the AC voltage so that the polarity applied across the electrodes thereof may alternate. Therefore, the service life of the liquid crystal in the display device may be remarkably increased. Furthermore, the present invention provides the very important advantage in practice that the commercial frequency of 50 and 60 Hz may be satisfactorily used, and if required the liquid crystal display device may be driven with a frequency ranging from 0.01 Hz to 200 Hz.

Figure 10:
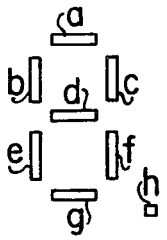
FIG. 10 is a diagram illustrating the mosaic array of the display segments in each liquid crystal display unit.
Figure 9:
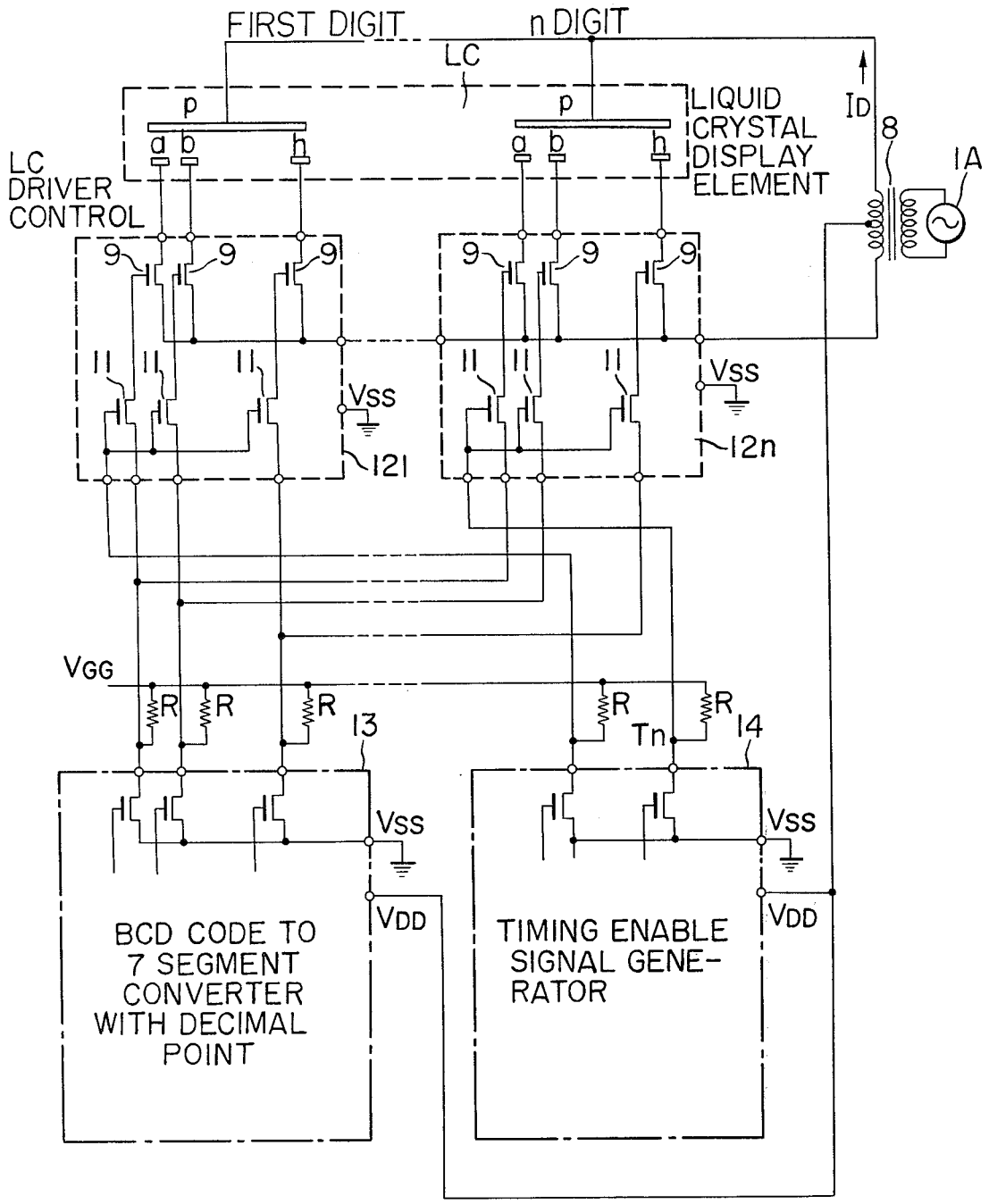
FIG. 9 is a circuit diagram of a liquid crystal display device to which the present invention is applied, the display device being shown as comprising $n$ digit display units each comprising a plurality of display segments arrayed in a mosaic form.

FIG. 9 is a circuit diagram of a liquid crystal display device to which is applied a driving system in accordance with the present invention, and which comprises *n* liquid crystal display units wherein each digit unit includes eight mosaic display segments or electrodes arrayed in the form of a numeral eight as clearly shown in FIG. 10. Parts similar to those shown in FIG. 7 are designated by the same respective reference numerals.

The common electrodes P of the digit display units are connected to one terminal of the secondary of the transformer 8 which is coupled to the power source $1_A$, and the source or drain electrodes of the MOSFETs are connected to the other terminal of the secondary of the transformer 8, whereas the other drain or source electrodes are connected to the segments *a-h.* To the gates of the MOS-FETs 9 are connected the drain electrodes of corresponding switching MOS-FETs 11, the sources of which are connected to a binary coded decimal code-to-7 segment convertor 13. The gates of the MOS-FETs 11 in each display unit or digit are connected to a common line which in turn is connected to a timing enable signal generator 14.

Figure 12:
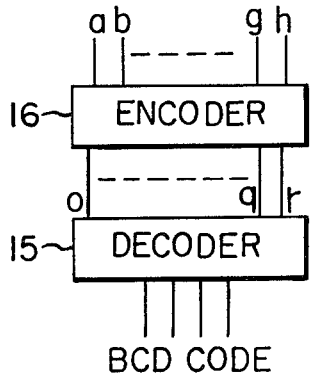
FIG. 12 is a schematic view of a cascaded decoder and encoder composing the converter in the circuit shown in FIG. 9.

As shown in FIG. 12, the converter 13 comprises a decoder 15 for decoding one of the binary coded decimal codes and/or decimal point signal, and an encoder 16 for encoding to provide a combination of signals to be applied to the segments *a-h* of each display unit in response to the output from the decocder 15. The converter 13 of the type described may be designed in various forms, but in the instant embodiment it is designed as an MOS-LSI for systemization. The timing-enable-signal generator 14 is also designed as an MOS-LSI. As described above, the bias voltage $V_{DD}$ of the MOS-FETs in the converters 13 and the generator 14 are connected to the midpoint of the secondary of the transfomer 8.

The timing-enable-signal generator 14 is used to apply the digit pulses to the display units or digits sequentially and repetitively from the first digit unit to the *n-th* digit unit on a time division basis.

Figure 11:
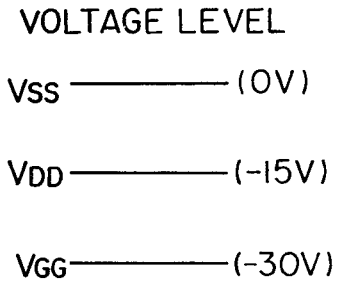
FIG. 11 is a view illustrating the levels of the voltages applied to the MOS transistors in the circuit shown in FIG. 9.

All of the MOS-FETs 9 and 11 in each unit or digit are formed as a driving circuit 12, one terminal of which is formed on a common substrate S and is connected to a lead line which is maintained at a ground potential. In the illustrated embodiment, the MOS-FETs take potentials as shown in FIG. 11. This arrangement is advantageous in that the DC coupling between the gate terminal and the source of drain terminal may be eliminated so that the non-directivity of the MOS-FET may be advantageously utilized for driving the liquid crystal display device with the AC power source.

When the diplay signal from the converter 13 and the digit pulse from the timing generator 14 are applied to the source and gate of each MOS-FET to cause it to conduct, the signal is transmitted to the gate of each transistor to cause its conduction. Therefore, the AC driving current flows between the common electrode P and the selected segments as shown in FIG. 6 to cause the selected segments to illuminate so that the desired numeral or the like may be displayed by each display unit.

Figures 13, 14:
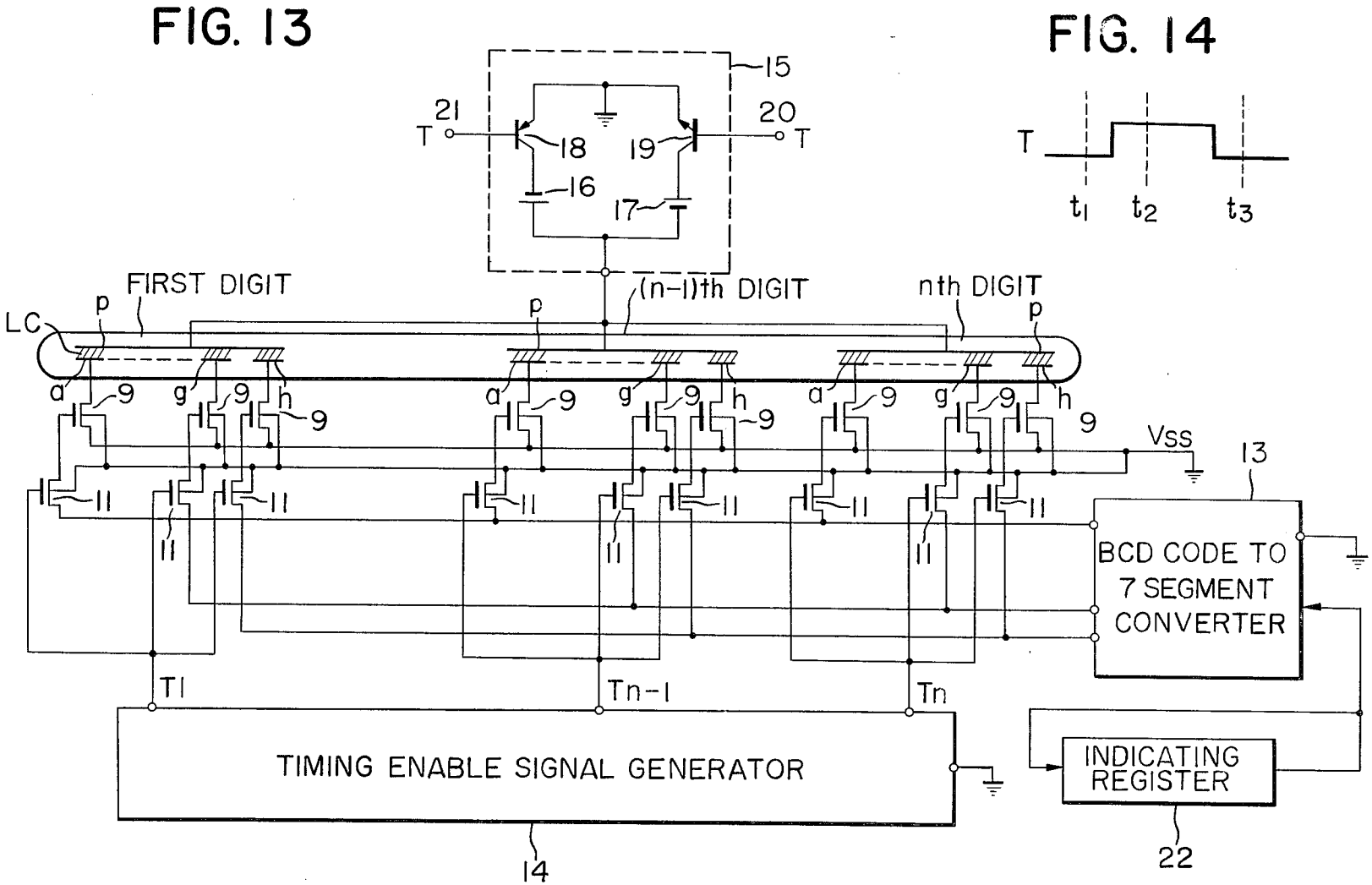
FIG. 13 is a circuit diagram of another embodiment of the invention, in which a direct current source is alternatively used instead of an alternating current source 1A shown in FIG. 9.
FIG. 14 shows a chart of the waveform of a polarity altering control signal available for the embodiment of FIG. 13.

Referring to FIG. 13, there is shown another embodiment of the invention which uses another type of a power supply for altering the polarity of voltage to be supplied to the electrodes of the liquid crystal display unit. The power supply 15 comprises a direct current source 16, a transistor 18 having its collector connected to the negative pole of the source 16, another direct current source 17, and a second transistor 19 having its collector connected to the positive pole of the source 17. The junction of the positive pole of the DC source 16 and the negative pole of the DC source 17 is connected to a common lead for a common electrode p of the liquid crystal display unit. The junction of the emitters of the transistor 18 and 19 is grounded, and the bases of the transistors are connected to respective terminals 21 and 20 for applying polarity control signals. It should be noted that in FIG. 13 the same components as those of FIG. 9 are assigned the same reference numerals. Each of the first MOS transistors 9 have first electrodes connected respectively to the segments of the liquid crystal display unit, and have second electrodes connected to ground, as shown in FIG. 13.

In operation, assuming that the polarity control signal T as shown in FIG. 14 is applied to the terminals 21 and 20 connected to the bases of the transistors 18 and 19, at the time $t_1$ the transistor 18 is turned ON, while the transistor 19 is turned OFF. Thus, when the MOS transistors are rendered conductive in response to the display signal from BCD-code to 7-segment converter 13 and the timing enable signal generator 14, the DC source 16 supplies a voltage across the common electrode p of the display unit and the electrodes associated with the conduction MOS transistors 9, with the polarity being such that the common electrode is positive and the display electrodes are negative. At the time $t_2$, the transistor 18 is turned OFF and the transistor 19 is turned ON. At this time, when the MOS transistor or transistors are rendered conductive in response to the display signal from the converter 13 and the signal generator 14, the DC source 17 supplies a voltage across the common electrode of the display unit and the corresponding display electrode or electrodes connected to the conducting MOS transistor or transistors 9, with the polarity being such that the common electrode is negative and the display or electrodes are positive. Accordingly, the polarity of both electrodes is alternately changed with the result that the life time of the liquid crystal is lengthened. The frequency of the polarity control signal T may be appropriately determined to effectively extend the life time of the liquid crystal.

Figure 15:
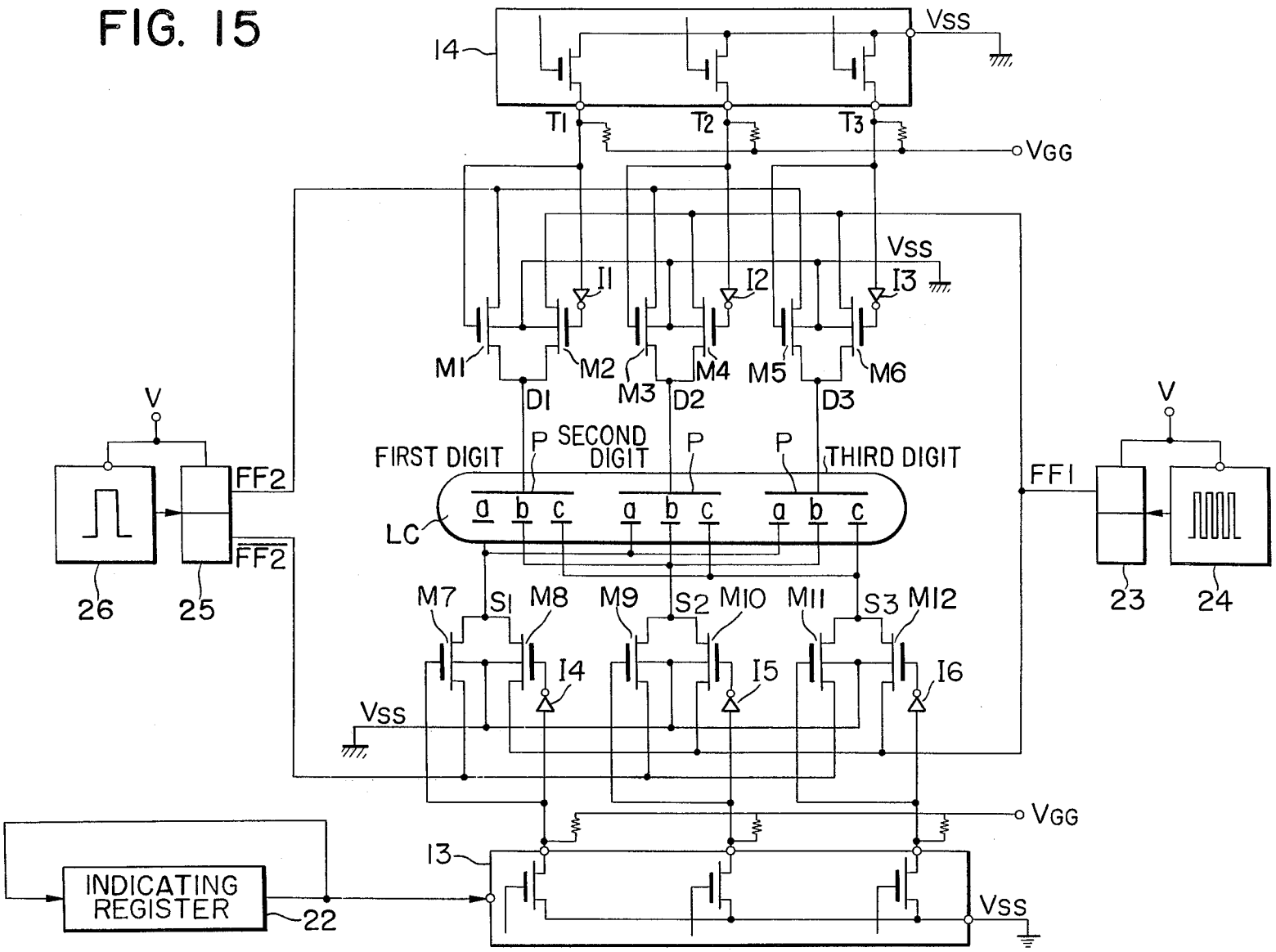
FIG. 15 shows a circuit diagram of still another embodiment of the present invention.

In any event that the liquid crystal display device of the present invention is used as a display apparatus of a computer, or for a desk top type electronic calculator or the like, the display device is prefarably designed so that the common electrode is energized in response to voltage of one polarity when the operational function is performed, and the common electrode is energized in response to voltage of the other polarity when the display function is perfomed. In another example, the discharge characteristics of a capacitor may be effectively employed for alteration of the polarity of applied voltage. As is apparent from the above, the illustrated embodiment has an advantage in that the timing of the control signal to be applied can be appropriately determined to allow for different timing requirements. FIG. 15 shows another embodiment of the invention in which the MOS transistors are reduced in number as compared with the embodiments shown in FIGS. 9 and 13. For simplicity of explanation, it is assumed the one digit unit comprises three display segments or electrodes *a*, *b* and *c* and the display unit comprises three digit units and that the liquid crystal display device is driven on a dynamic display basis, while alternately changing the polarity of the supplied voltage.

In an indicating register 22, 3 digit data to be displayed on a dynamic basis are stored and circulated, and during the interval of timing signal $T_1$ the first digit data are read out from the indicating register 22 into the BCD code converter 13. The converter 13 generated signals for selecting the display electrodes *a*, *b* and *c*. Similarly, the second and third digit data are read out from the indicating register 22 into the converter 13 at the timing $T_2$ and $T_3$, respectiely. It is assumed that the data read out from the indicating register 22 are such that the first digit signal is applied to the display electrode *a*, the second digit signas is applied to the display electodes *a* and *b*, and the third digit signal does not appear. Each of the display electrodes *a*, *b* and *c* is connected to two parallel connected MOS transistors, M7, M8; M9, M10; M11, M12. Each of three common electrodes p are connected to two parallel connected MOS transistors, M1, M2; M3, M4; M5, M6. Thus, the first electodes of the transistors M1 and M2 are connected to the first digit common electrode p, and the second electrode of the transsistor M1 is connected to the set terminal of a flip flop and M5. The second electrode of the transistor M2 is connected to the set terminal of a flip flop 23 together with the second electrodes of the transistors M4 and M6. The flip flops 23 and 25 are of the triggering type, which are alternately set and reset in response to the reception of input pulses. The flip flops 23 and 25 have triggering input terminals connected to pulse generators 24 and 26, respectively, to apply trigger pulses thereto.

Figure 16:
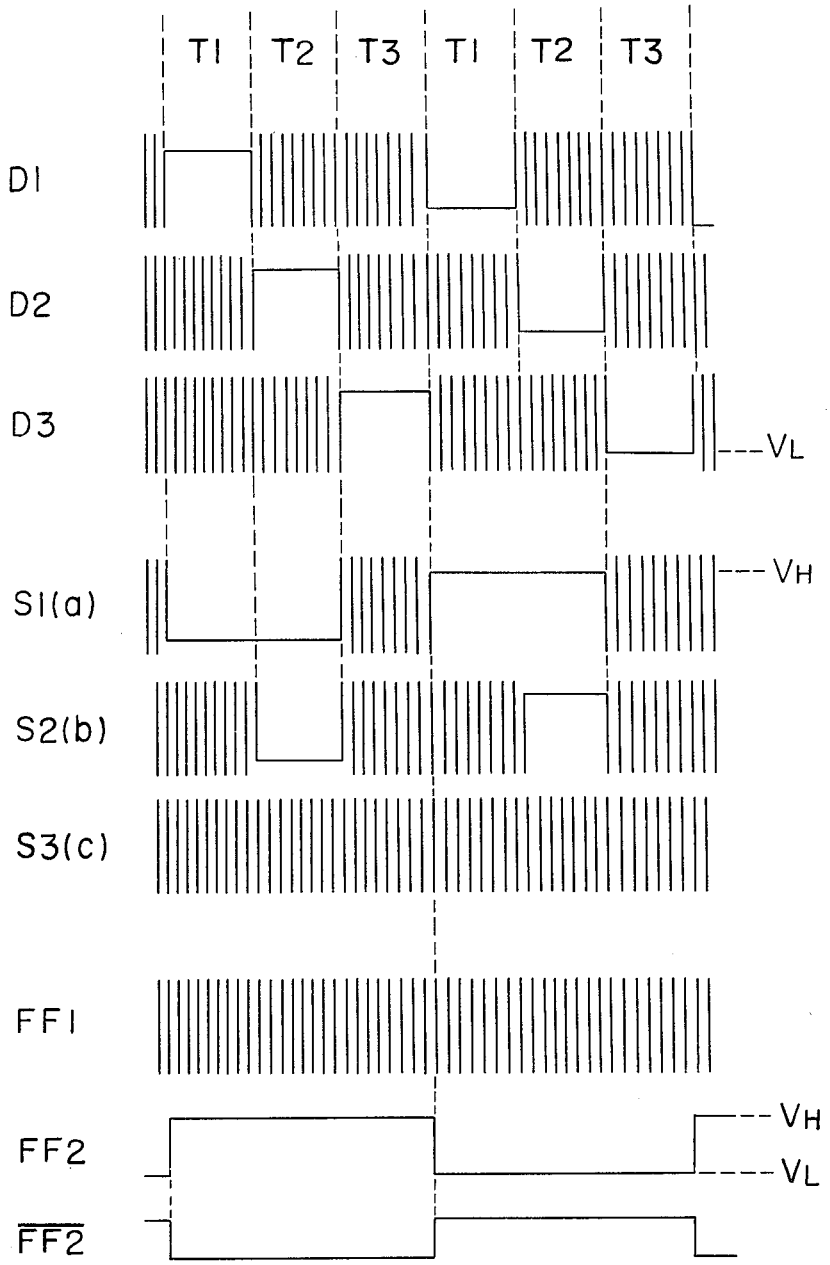
FIG. 16 shows a chart of waveforms for explanation of the operation of the embodiment shown in FIG. 15.

The repetitive rate of the pulse from the pulse generator 24 is high, and is sufficient to improve the falling characteristics of the liquid crystal used in the display unit, as shown by FF1 in FIG. 16. The repetitive rate of the pulse from the pulse generator 26, as shown by FF2 in FIG. 16, may be low to the extent that the pulse width of the pulse of one polarity corresponds, in time, to the timer interval required for three digit data circulate in the register. The positive and negative pulses having the same pulse width are alternately applied to the flip flop 25 to alter the polarity of voltage to be supplied to the electrodes of the liquid crystal display unit. However, the repetitive rate of the pulses generated in the pulse generator 26 may be aribitrarily determined.

The gate electrode of the MOS transistor M1 is connected to the output terminal for digit timing signal T1 of the timing enable signal generator 14. The gate electrode of the MOS transistor M2 is connected to the output terminal for timing signal T1 through an inverter I1.

Similarly, the gate electrodes of the MOS transistors M3 and M5 are connected to the output terminals for timing signals T2 and T3 to which the gate electrodes of the MOS transistors M4 and M6 are connected through inverters 12 and 13, respectively.

The first electrode of a pair of parallel connected MOS transistors M7 and M8 is connected to the electrode a of each of the digit units, and similarly the first electrodes of pairs of parallel connected MOS transistors M9, M10, M11 and M12 are connected to the electrodes *b* and *c* of each of the digit units, respectively. The gate electrodes of the MOS transistors M7, M9 and M1 are connected to corresponding output terminals of the BCD code converter 13, to which the gate electrodes of the MOS transistors M8, M10 and M12 are connected through inverters 14, 15 and 16, respectively. The second electrodes of the MOS transistors M7, M9 and M11 are connected together to the reset terminal of a flip flop 25, while the second electrodes of the MOS transistors M8, M10 and M12 are connected together to the set terminal of the flip flop 23.

The operation will be described referring to FIGS. 15 and 16. During the interval of digit timing singlal T1, the MOS transistor M1 is rendered conductive and output FF2 of the flip flop 24 is supplied to the common electrode P of the first digit unit. During the intervals of timing signals T2 and T3, the MOS transistor M2 is rendered conductive, and output FF1 of the flip flop 23 is supplied to the common electrode P of the first digit unit. The waveform of voltage supplied to the first digit common electrode is shown in the row D1 of FIG. 16. Similarly, the waveforms of voltage supplied to the second and third digit common electrodes are shown in the rows D2 and D3 of FIG. 16.

At the timing signal T1 and T2, simultaneously the indicating register 22 reads out a signal for selecting the display electrode *a* and thus the MOS transistor M7 is rendered conductive. Therefore, the reset output FF2 from the flip flop 25 is supplied to the display electrode *a* of the display unit. Similarly, at the timing singal T3, the MOS transistor M8 is rendered conductive and the output FF1 of the flip flop 23 is supplied to the display electrode *a*. Therefore, the waveform of voltage supplied to the display electrodes *a* becomes as shown in the row S1 if FIG. 16. The voltage is supplied to the display electrodes *b* only at time T2, and the voltage waveform becomes as shown in row S2 of FIG. 16. At the times, T1, T2 and T3, the display electrodes *c* are not displayed and the voltage waveform thereof is shown in row S3 of FIG. 16. In the assumed example, it is to be understood that at the time T1 only the display electrode *a* in the first digit unit is selected and displayed. At the time T2, the display electrodes *a* and *b* in the second digit unit are selected and displayed. And at time T3, no display electrode in the third digit unit is selected. In such manner, dynamic driving of one cycle is performed. In this case, the potential of the diplay unit is such that the common electrode P is high (e.g., VH is assumed) and the display electrodes *a* - *c* are low (e.g., VL is assumed). With the potential difference VH - VL, the display function is carried out.

In operation of the second cycle of the dynamic driving of the device according to the invention, the flip flop 5 is reversed, because the oscillation frequency of the clock pulse generator 26 is set so that the flip flop is reversed every cycle of the dynamic driving of the device. The timing of the second cycle is shown in the right half part of FIG. 16. As illustrated, the potential of the common electrodes P is low V1, and the potential of the display electrodes *a* - *c* is high VH. Therefore, with the potential difference VH - VL, the display function is also carried out. It should be noted that in the second cycle following the first cycle, the polarities of the voltage supplied across the common electrodes and the display electrodes are reversed. This serves to extend the life time of the liquid crystal display device. Furthermore, in this embodiment it is feasible to operate the device on the dynamic driving basis with less MOS transistors, thus providing for low cost and compactness in size of the device.

Figure 17:
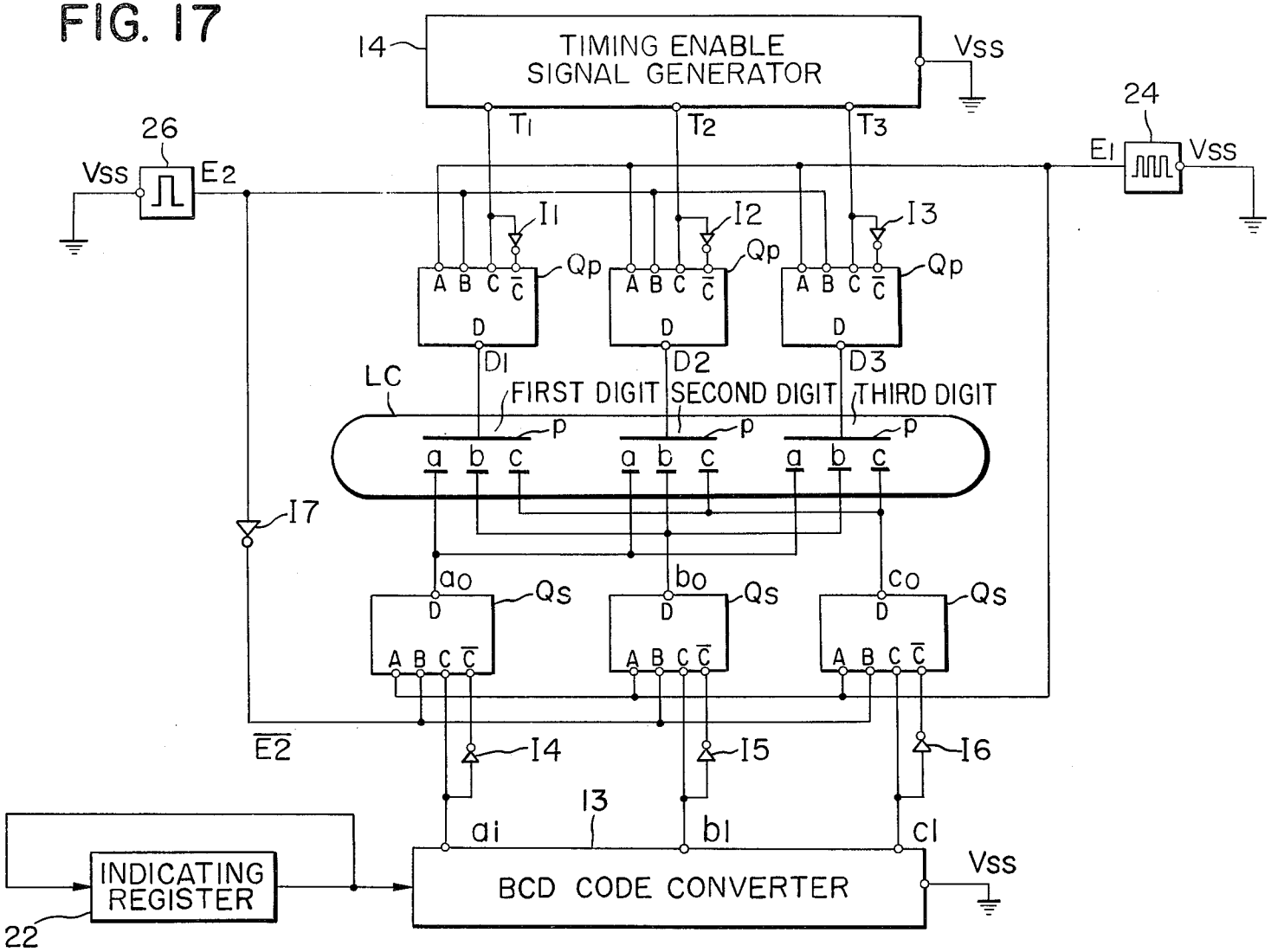
FIG. 17 shows a circuit diagram of another embodiment of the present invention.
Figure 18:
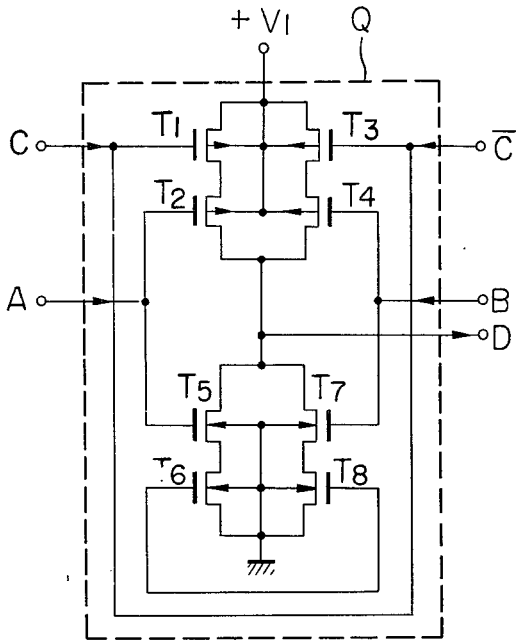
FIG. 18 shows a circuit diagram illustrating an arrangement of a driving circuit Q used in the embodiment of FIG. 17.

FIG. 17 shows a variation of the embodiment shown in FIG. 15 in which each pair of the MOS transistors, for example M1 and M2, is replaced by a driving circuit Q. Other components are substantially the same as those of FIG. 15. Each driving circuit Q comprises, as shown in FIG. 18, P channel MOS transistors T1 - T4 and N channel MOS transistors T5 -T8, forming a complementary configuration. To terminals A and B of each of the driving circuits is supplied output E1 of a high frequency voltage source 24 for deenergizing the liquid crystal, and output E2 of a voltage source 26 for reversing the polarity, or reversed output $\overline{E2}$, respectively. To the terminal C, a control and selection signal is applied from the timing enable signal generator 14 or BCD code converter 13. To the terminal $\overline{C}$, a reversed output signal is applied from the timing enable signal generator 14 or BCD code convertor 13. The driving circuits connected to the timing enable signal generator 14 will be referred to as "Qp", and the driving circuits connected to BCD code converters 13 will be referred to as "QS".

Figure 19:
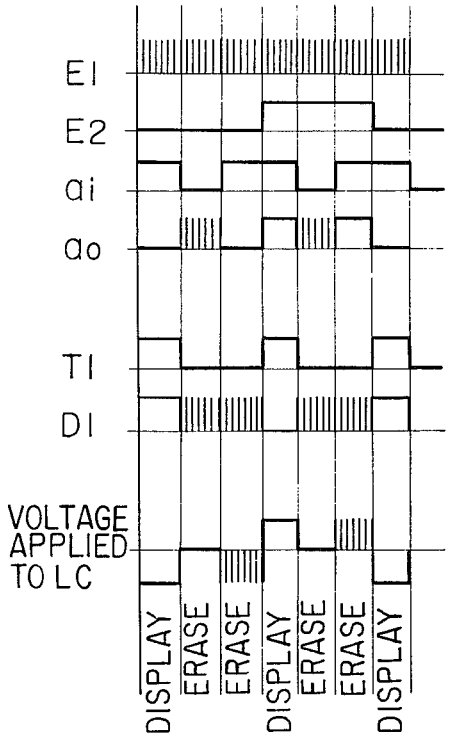
FIG. 19 shows a chart of waveforms for explanation of the operation of the embodiment shown in FIG. 17.

In operation, it is assumed that signals E1 and $\overline{E2}$ are applied to the terminals A and B of the driving circuits QS, and that a display signal, for example, ai, is applied to the terminal C of the first driving circuit QS and a reversed signal is applied to the terminal $\overline{C}$ thereof from the BCD code converter 13. On the other hand, at this time, the first digit timing signal T1 and reversed signal T1 are applied to the terminals C and C of the driving circuit QP connected to the common electrode P of the first digit unit, respectively. When the timing signal T1 is applied to the terminal C of the driving circuit QP, output D1 is generated as shown in FIG. 19. At this time, when signal ai is applied to the driving circuit QS, output ao is generated as shown in FIG. 19. Therefore, at the timing T1 the potential difference is established across the display electrode *a* and the common electrode P of the first digit unit, and the segment *a* is displayed. At the timings T2 and T3, output signal ao or D1 includes high frequency components for de-energizing the display and thus no display is made.

Figure 20:
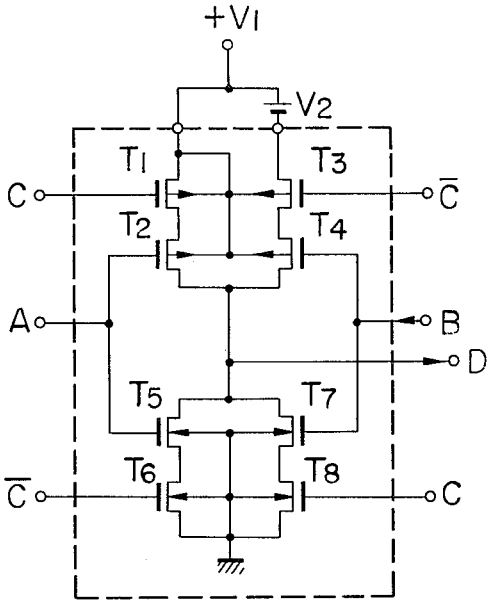
FIG. 20 shows a circuit diagram of a variation of the circuit shown in FIG. 18.

FIG. 20 shows a variation of the embodiment as shown in FIG. 18, in which a battery V2 is inserted between the first electrode of a MOS transistor T3 and the voltage source V1. With this battery, the magnitude of the digit driving voltage is decreased by V2. This serves to improve the contrast of the display. As shown in FIG. 2, the contrast ratio of the display is not proportional to the magnitude of D.C. driving voltage to be supplied, and if D.C. driving voltage is too great, it results in induction of voltage to the adjacent, non-selected display electrode, with the result that it causes a decrease in the contrast. However, when the magnitude of D.C. driving voltage is decreased as shown in FIG. 20, the difficulty is solved and dynamic driving of the liquid crystal display device is facilitated.

Figure 21:
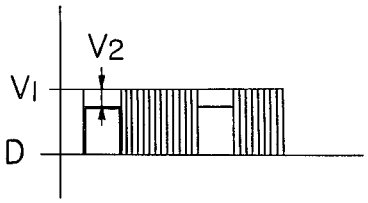
FIG. 21 shows a chart of waveform for explanation of the operation of FIG. 20.

FIG. 22 illustrates another variation of the driving circuit Q, in which the circuit is constructed with P channel MOS transistors. And FIG. 23 shows a modified circuit to which a battery V2 is coupled in the same manner as that of FIG. 21. It has been found that the contrast is improved by substantially equalizing the time width of the high level and low level of the high frequency voltage, that is, by making the duty factor to be 0.5. It is supposed that this is due to the fact that the direct current component is not included in the voltage supplied across both of the electrodes of the display unit.

Figure 24:
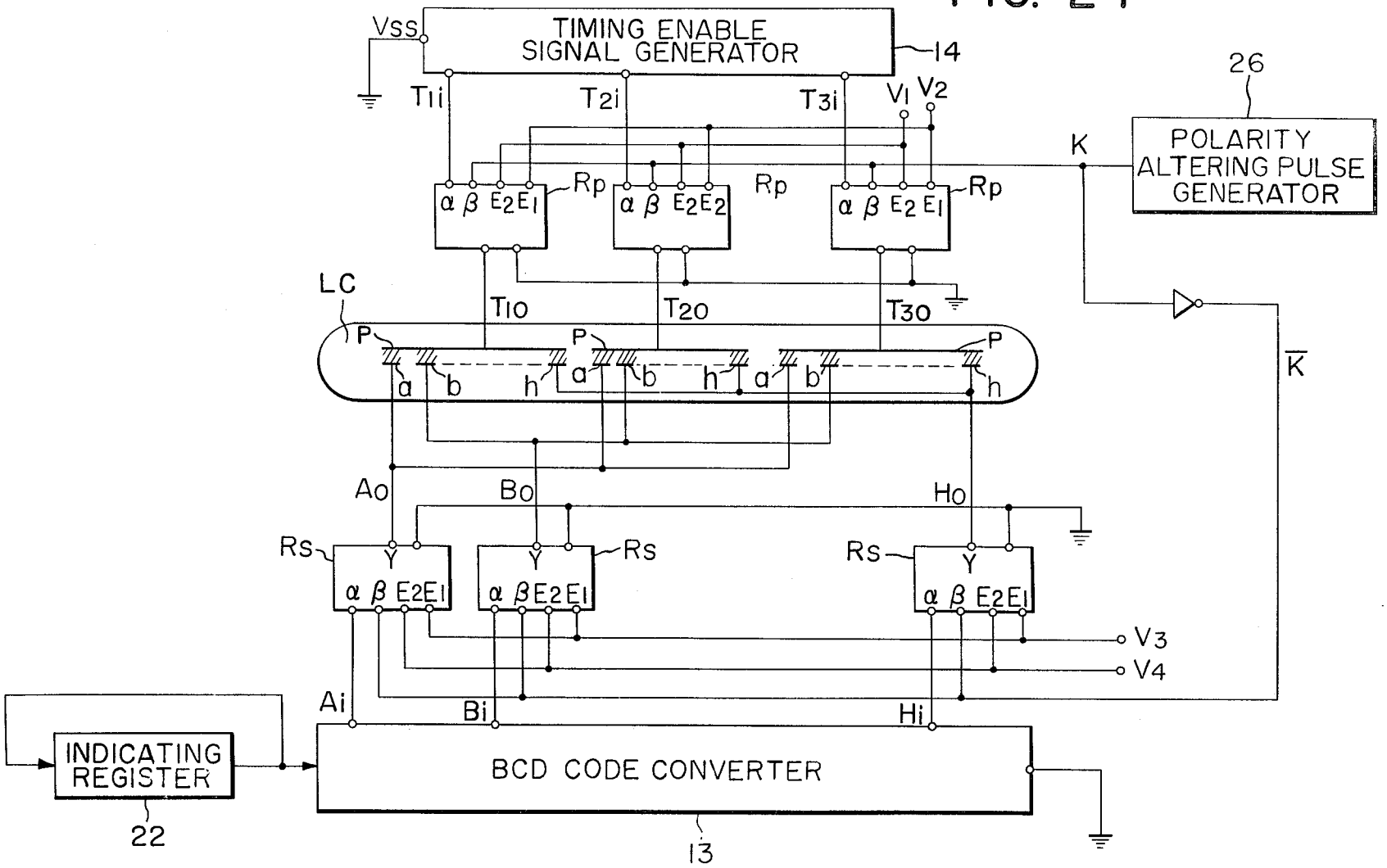
FIG. 24 shows a circuit diagram of still another embodiment of the present invention.

FIG. 24 illustrates another embodiment of the present invention, in which the high frequency generator source for erasing is not used and only the pulse generator 26 for altering the polarities as shown in FIGS. 15 and 17 is employed. In the illustrated embodiment, each of driving circuits Rp and Rs for respective common electrodes *p* and display electrodes *a* - *h* are constructed with a circuit as shown in FIG. 25. The same components are assigned the same reference numerals as in FIGS. 15 and 17. The driving circuit as shown in FIG. 25 comprises P channel MOS transistors T17 - T19 and N channel MOS transistors T20 - T22. The substrate of a P channel MOS transistor T17 is connected to the terminal E1 and the substrate of N channel MOS transistor T21 is connected to ground. Logic outputs appearing on the output terminal Y when input signals of levels 0 and 1 are applied to the input terminals $\alpha$ and $\beta$ are shown in FIG. 26. In this case the voltages V1 and V2 are supplied to the input terminals E1 and E2, respectively, where it is assumed that the magnitude of the voltages is V1>V2>0. As shown in the Table of FIG. 26, when logic input 1 is applied to the terminal $\alpha$, the transistors T17 and T21 are rendered conductive and the transistors T19 and T22 are rendered non-conductive. Thus, the output terminal Y generates an output signal equal to B (in this case, equal to V1).

Figure 27:
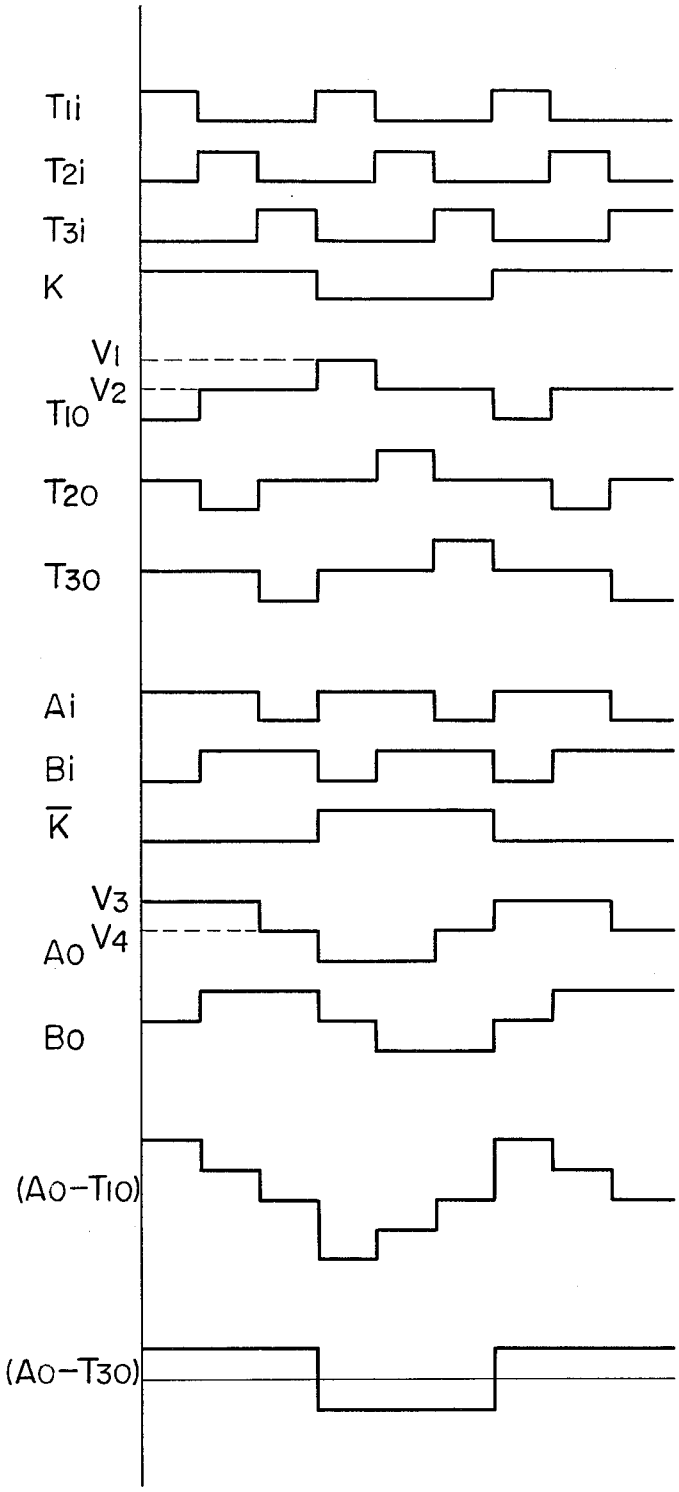
FIG. 27 shows a chart of waveforms for explanation of the operation of the embodiment shown in FIG. 24.

On the other hand, when logic input 0 is applied to the terminal $\alpha$, the transistors T17 and T21 are rendered nonconductive and at least one of the transistors T19 and T22 is rendered conductive, with the result that the output terminal generates output V2. Referring to FIG. 27, there is shown a timing chart for explanation of the operation of the embodiment shown in FIG. 24. In the drawing, the frequency of the polarity altering signal P may be arbitrarily selected, and in the illustrated embodiment the polarity of the driving voltage to be supplied is reversed every cycle of the operation of the display unit. Alternatively, it is feasible to select the frequency of the pulse generator 26 so that the polarity of the driving voltage is reversed every half digit cycle.

FIG. 28 denotes a modification of the driving circuit as shown in FIG. 22, in which the invertor is composed of MOS transistors.

As set forth above MOS transistors are employed for a circuit for driving a liquid crystal display device on a dynamic basis, and therefore it is possible to make the device compact in size. Also, the life time of the liquid crystal is extended by reversing alternately the polarity of the driving voltage to be supplied.

From the foregoing description, it is seen that the crystal display device driving system in accordance with the present invention is very simple in construction and is very effective to increase the service life of liquid crystal used in the display device, and the AC driving system of the present invention can solve the problems of remanence of the liquid crystal display.

I claim:

1. A system for driving a liquid crystal display device comprising in combination:

a liquid crystal display device having a plurality of liquid crystal digit display units each comprising a common electrode, a plurality of display segments opposed to and spaced from said common electrode, and a liquid crystal material interposed between said common electrode and said plurality of display segments;

means for electrically connecting corresponding ones of said display segments in each of said liquid crystal digit display units;

a timing enable signal generator for generation signals to sequentially and cyclically drive the respective said common electrodes of said liquid crystal digit display units;

a code converter for producing signals to selectively drive said display segments;

a recirculating register adapted to be recirculated in one cycle period of said timing enable signal generator for providing numerical information to said code converter; and means for altering polarities of the signals from said timing enable signal generator and of the signals from said code converter every integral multiple of one recirculating period of said recirculating register, said means including a polarity alternating pulse generator, a plurality of first groups of gating means to which are supplied the signals from said polarity altering pulse generator and the signals from said timing enable signal generator and from which output signals are respectively applied to said common electrodes of said digit display units, and a plurality of second groups of gating means to which are supplied the signals from said polarity altering pulse generator and the signals from said code converter and from which output signals are respectively applied to said display segments of said digit display units.

2. A system as defined in claim 1, wherein the system further comprises means for applying high frequency pulses sufficient to provide an erasing effect to all display units other than the said unit to which a said timing enable signal is being applied.

3. A system as defined in claim 2, further comprising means for providing said timing enable pulses at a level less than a peak value level of said high frequency pulses.

4. A system as defined in claim 1, wherein the system further comprises means for applying a DC voltage having a magnitude less than that required to provide a display effect to all display units other than that to which a said timing enable signal is being applied.

5. A system as defined in claim 1, wherein said first and second groups of gating means comprise MOS transistors.

6. A system as defined in claim 1, wherein each of said gating means includes input terminals for receiving said signals applied thereto, an output teminal, and at least one additional input terminal to which is applied a DC voltage having a magnitude less than required to provide a display effect to said digit display units.

7. A system as defined in claim 6, wherein each of said gating means includes a second additional input terminal to which is applied a DC voltage having a level different than that applied to said one terminal thereof.

8. A system for driving a liquid crystal display device comprising in combination:

a liquid crystal display device having a plurality of liquid crystal digit display units each comprising a common electrode, a plurality of display segments opposed to and spaced from said common electrode, and a liquid crystal material interposed between said common electrode and said plurality of display segments;

means for electrically connecting corresponding ones of said display segments in each of said liquid crystal digit display units;

a timing enable signal generator for generating signals to sequentially and cyclically drive the respective said common electrodes of said liquid crystal digit display units;

a code converter for producing signals to selectively drive said display segments;

a recirculating register adapted to be recirculated in one cycle period of said timing enable signal generator for providing numerical information to said code converter;

means for altering polarities of the signals from said timing enable signal generator and of the signals from said code converter every integral multiple of one recirculating period of said recirculating register, said means including a polarity alternating pulse generator, a plurality of first groups of gating means to which are supplied the signals from said polarity altering pulse generator and the signals from said timing enable signal generator and from which output signals are respectively applied to said common electrode of each of said digit display units, and a plurality of second groups of gating means to which are supplied the signals from said polarity altering pulse generator and the signals from said code converter and from which output signals are respectively applied to said display segments of each of said digit display units;

wherein each of said gating means comprises;

first and second pairs of MOS transistors having gate electrodes to which are applied the signals from said timing enable signal generator or the signals from said code converter, the MOS transistors of said first pair each having respective main electrodes connected to DC voltages having a magnitude less than that required to cause said digit display units to be displayed;

a third pair of MOS transistors having gate electrodes to which are applied the signals from said polarity altering pulse generator;

means for electrically connecting the other main electrode of one of said first pair MOS transistors with one of two main electrodes of one of said third pair of MOS transistors;

means for electically connecting the other main electrode of said one of the third pair of MOS transistors with one of two main electrodes of the other of said third pair of MOS transistors;

means for electrically connecting the other main electrode of the other of said third pair of MOS transistors with one of hawe two main electrodes of one MOS transistor of the second pair;

means for electrically coupling the other main electrode of said one MOS transistor of the second pair to a reference potential;

means for electrically connecting the other main electrode of the other MOS transistor of said first pair with one of two main electrodes of the other of said second pair of MOS transistors;

means for electrically connecting the other main electrode of the other said second pair of MOS transistors with one main electrode of the other of said first pair of MOS transistors; and means for electrically connecting said output terminal to a junction between the other main electrode of the other of said first pair of MOS transistors and one main electrode of the other of said second pair of MOS transistors.

9. A system for driving a liquid crystal display device comprising in combination:

a liquid crystal display device having a plurality of liquid crystal digit display units each comprising a common electrode, a plurality of display segments opposed to and spaced from said common electrode, and a liquid crystal material interposed between said common electrode and said plurality of display segments;

means for electrically connecting corresponding ones of said display segments in each of said liquid crystal digit display units;

a timing enable signal generator for generating signals to cyclically drive the respective said common electrodes of said liquid crystal digit display units;

a code converter for producing signals to selectively drive said display segments;

a register for providing numerical information to said code converter;

means for changing levels of the signals from said timing enable signal generator and of the signals from said code converter every integral multiple of one cycle period of said timing enable signal generator;

a plurality of first groups of gating means to which are supplied the signals from said signal level changing means and the signals from said timing enable signal generator and from which output signals are applied to said common electrode of each of said digit display units; and a plurality of second groups of gating means to which are supplied the signals from said signal level changing means and the signals from said code converter and from which output signals are applied to said display segments of each of said digit display units;

wherein each of said gating means includes input terminals for receiving said respective signals, an output terminal, and at least one additional input terminal to which is applied a DC voltage having a magnitude less than that required to provide a display effect to said digit display units.

10. A system as defined in claim 9, wherein each of said gating means includes a second additional input terminal to which is applied a DC voltage having a level different than that applied to said one additional terminal thereof.

* * * * *

UNITED STATES PATENT AND TRADEMARK OFFICE

CERTIFICATE OF CORRECTION

PATENT NO. : 4,027,305

DATED : May 31, 1977

INVENTOR(S) : JUJI KISHIMOTO

It is certified that error appears in the above-identified patent and that said Letters Patent are hereby corrected as shown below:

Column 1, line 28, after "the" insert --nematic liquid crystal whose major portion is anisylidene- --.

Column 4, line 2, change "appled" to read --applied--.

Column 5, line 4, change "decocder" to read --decoder--;

line 12, change "transfomer" to read --transformer--;

line 24, delete "of" and insert --or--.

Column 6, line 3, change "conduction" to read --conducting--;

line 15, after "display" insert --electrode--;

line 23, delete "any" and insert --the--;

line 25, change "prefarably" to read --preferably--;

line 30, change "perfomed" to read --performed--;

lines 51 and 52, change "generated" to read --generates--;

line 54, change "respectiely" to read --respectively--;

line 57, change "signas" to read --signal--;

line 58, change "electodes" to read --electrodes--;

line 64, change "electodes" to read --electrodes--;

line 66, change "transsistor" to read --transistor--;

UNITED STATES PATENT AND TRADEMARK OFFICE

CERTIFICATE OF CORRECTION

PATENT NO. : 4,027,305
DATED : May 31, 1977
INVENTOR(S) : JUJI KISHIMOTO

It is certified that error appears in the above-identified patent and that said Letters Patent are hereby corrected as shown below:

Column 6, line 67, after "flip-flop" insert --25 together with the second electrodes of the transistors M3--.

Column 7, line 15, change "timer" to read --time--;

line 21, change "aribitrarily" to read --arbitrarily--;

line 33, delete "12 and 13" and insert --I2 and I3--;

line 41, change "M1" to read --M11--;

line 44, delete "14, 15 and 16" and insert --I4, I5 and I6--;

line 52, change "singlal" to read --signal--;

line 54, delete "24" and insert --25--.

Column 8, line 1, change "singal" to read --signal--;

line 6, delete "if" and insert --of--;

line 25, delete "5" and insert --25--.

Column 9, line 2, change "C and C" to read --C and $\overline{C}$--;

line 67, change "B" to read --$\beta$--.

UNITED STATES PATENT AND TRADEMARK OFFICE

CERTIFICATE OF CORRECTION

PATENT NO. : 4,027,305

DATED : May 31, 1977

INVENTOR(S) : JUJI KISHIMOTO

It is certified that error appears in the above-identified patent and that said Letters Patent are hereby corrected as shown below:

Column 10, line 45, change "generation" to read --generating--.

Column 12, line 19, change "electically" to read --electrically--;

line 25, delete "hawe" and insert --the--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

Certificate

Patent No. 4,027,305 Patented May 31, 1977

Juji Kishimoto

Application having been made by Juji Kishimoto, the inventor named in the patent above identified, and Canon Kabushiki Kaisha, the assignee, for the issuance of a certificate under the provisions of Title 35, Section 256, of the United States Code, adding the names of Sakae Houryu and Hiroyuki Mikada as joint inventors, and a showing and proof of facts satisfying the requirements of the said section having been submitted, it is this 4th day of April 1978, certified that the names of the said Sakae Houryu and Hiroyuki Mikada are hereby added to the said patent as joint inventors with the said Juji Kishimoto.

FRED W. SHERLING,
*Associate Solicitor.*